US007850266B2

(12) United States Patent
Kasai

(10) Patent No.: US 7,850,266 B2
(45) Date of Patent: Dec. 14, 2010

(54) ELEMENT SUBSTRATE FOR RECORDING HEAD, RECORDING HEAD, HEAD CARTRIDGE, AND RECORDING APPARATUS

(75) Inventor: Ryo Kasai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 214 days.

(21) Appl. No.: 12/059,934

(22) Filed: Mar. 31, 2008

(65) Prior Publication Data

US 2008/0238969 A1 Oct. 2, 2008

(30) Foreign Application Priority Data

Apr. 2, 2007 (JP) ..... 2007-096594

(51) Int. Cl.
*B41J 29/38* (2006.01)

(52) U.S. Cl. ..... 347/10; 347/5; 347/9; 347/11; 347/12

(58) Field of Classification Search ..... None
See application file for complete search history.

(56) References Cited

U.S. PATENT DOCUMENTS 6,243,111 B1 6/2001 Imanaka et al.
6,520,613 B1 2/2003 Tamura

*Primary Examiner*—Matthew Luu
*Assistant Examiner*—Justin Seo
(74) *Attorney, Agent, or Firm*—Canon USA Inc IP Div

(57) ABSTRACT

An element substrate for a recording head includes groups of heating resistors that are disposed next to one another in each group; logic circuits configured to time-divisionally drive the heating resistors in units of one block; a heat enable signal line common to the groups of heating resisters, the heat enable signal line supplying a heat enable signal to each of the groups of heating resisters; and delay circuits connected to the heat enable signal line at positions between the groups of heating resisters. A signal output from each delay circuit to the next group is inverted.

9 Claims, 11 Drawing Sheets

ELEMENT SUBSTRATE FOR RECORDING HEAD, RECORDING HEAD, HEAD CARTRIDGE, AND RECORDING APPARATUS

BACKGROUND OF THE INVENTION

1. Field of the Invention

The present invention relates to element substrates for recording heads, recording heads, head cartridges, and recording apparatuses. More particularly, the present invention relates to an element substrate for a head on which substrate heating resistors and drive circuits for driving the heating resistors are mounted, a recording head including the element substrate, a head cartridge including the recording head, and a recording apparatus including the recording head.

2. Description of the Related Art

Recording heads used in inkjet recording apparatuses have, as recording elements, discharge ports for discharging ink droplets and heating resistors (heaters). The heating resistors are composed of resistors or the like and are disposed in sections communicating with the discharge ports. A current is applied to the heating resistors so that the heating resistors generate heat to generate bubbles of ink vapor, whereby ink droplets are discharged from the discharge ports to record an image. Such a recording head allows many discharge ports and heating resistors to be arranged at a high density, and therefore the recording head is capable of performing high-definition recording.

FIG. 7 is a block diagram illustrating the circuit structure of a known recording head.

FIG. 8 is a schematic diagram illustrating the circuit layout of the recording head shown in FIG. 7.

To perform high-speed recording using the recording head, the number of heaters 110 that can be driven simultaneously is set as large as possible. However, there is a limit to current-supplying performance of an electric wire 107 to which a power supply voltage (VH) is applied. In addition, as the current is increased, a larger voltage drop occurs due to a parasitic resistance of the electric wire 107. Therefore, it is difficult to supply desired energy to a large number of heaters 110, and the number of heaters 110 that can be driven simultaneously is limited. Accordingly, the heaters 110 are divided into M groups (GR:1 to GR:M) and are driven at different times such that the heaters 110 in the same group are prevented from being driven simultaneously. Thus, a maximum current that is applied instantaneously is suppressed.

U.S. Pat. No. 6,520,613 describes an example of a circuit structure that drives in the above-described manner.

According to U.S. Pat. No. 6,520,613, M groups of N heaters are provided and are time-divisionally driven such that M heaters are driven at a time in a single driving block and N driving blocks are performed. Matrix driving is carried out in which the heaters are selected by a logical product of an output (DATA) from shift registers that store data for M heaters and an output (BLE) of N decoder signals. According to this structure, the circuit scale can be reduced and the occurrence of malfunction can be reduced because data is time-divisionally transmitted.

In the recording head, a data signal (DATA) corresponding to recording data and time-division control data is serially transmitted to shift registers in synchronization with a clock signal (CLK). The shift registers are divided into two types in accordance with the data corresponding thereto. More specifically, the shift registers are divided into a several-bit shift register 105*a* and M-bit shift registers 105*b*-1 to 105*b*-M. The data signal (DATA) includes M bits of recording data from the leading end thereof, and recording data signals corresponding to the recording data are output from M-bit latches corresponding to the M-bit shift resisters 105*b*-1 to 105*b*-M. The remaining bits of data are input to the shift register 105*a* and are decoded by a decoder, whereby N-bit BLE signals (block selection signals) are obtained. The N BLE signals are output at the time when a latch signal is switched to "H". None of the N BLE signals are set to "H" simultaneously with another BLE signal, and only one BLE signal is set to "H" at a time.

In FIGS. 7 and 8, a combination of the decoder and the latch is denoted by 106. In addition, in FIGS. 7 and 8, the M-bit shift resisters 105*b*-1 to 105*b*-M corresponding to the M groups are shown in combination with the respective latches.

The heaters 110, driven by AND circuits 114 that are connected to the block selection signal line at which the BLE signal is set to "H" and to signal lines of the shift registers 105*b*-1 to 105*b*-M at which the corresponding bits of the M-bit data are set to "H", are selected as the heaters 110 to be driven. The heaters 110 are driven by receiving a current in accordance with the selection signals output from the AND circuits 114 and a heat enable (HE) signal.

The above-described operation is repeated N times so that all of the M×N heaters can be selected. More specifically, the heaters are time-divisionally driven at N time points, M heaters being driven at each time point.

In the recording head having the above-described structure, M heaters are selected by a single block selection signal at substantially the same time. However, the M heaters are not driven at exactly the same time in practice, but are sequentially driven with time intervals of about several tens of nanoseconds.

An example of such a driving method is discussed in U.S. Pat. No. 6,243,111.

According to U.S. Pat. No. 6,243,111, the M heaters to be driven together are caused to receive the heat enable signal at slightly different times so that the current applied instantaneously is suppressed and noise can be reduced.

FIG. 9 shows a signal time chart illustrating delay control of the heat enable signal according to U.S. Pat. No. 6,243,111.

The left half of FIG. 9 shows the case in which the heat enable signal is applied without a delay to the M heaters that correspond to a single block and are selected to be driven together by the decoder. In this case, the total heater current that flows through the common electric wires is greatly changed at the rising and falling edges thereof. Therefore, large noise is generated due to the changes in the heater current. In comparison, in the right half of FIG. 9, the time at which the signal is applied to the heaters selected to be driven together by the decoder is successively delayed. In this case, the changes in the heater current that flows through common electric wires, such as a high-voltage-side (VH) electric wire and a low-voltage-side (GND) electric wire, can be reduced.

To apply the signal in the manner shown in the right half of FIG. 9, the heat enable signal for driving the heaters corresponding to the same block is controlled such that the heat enable signal is successively delayed at each group. Accordingly, malfunction of the circuits in the recording head substrate (element substrate) can be prevented and radiation noise can be reduced.

Delay circuits 111-1 to 111-M shown in FIG. 7 are used to shift the time at which the heat enable signal is applied. The delay circuits 111-1 to 111-M are provided for the respective groups and are arranged parallel to the arrangement direction of the heaters 110 and driver transistors 112. The delay circuits are provided on the electric line for transmitting the heat enable signal to the heaters in each group at positions between the groups. Accordingly, the M heaters are successively driven by the heat enable signal that is successively delayed as shown in the right half in FIG. 9. CR integrating circuits are used as the delay circuits. In each CR integrating circuit, the capacitance (C) component is a gate capacitance and a parasitic capacitance of the electric wire, and the resistance (R) component is an ON resistance of a metal-oxide silicon (MOS) transistor of a complementary metal-oxide semiconductor (CMOS) inverter included in the delay circuit and a parasitic resistance of the electric wire. The signal delay is generated using the delay (bluntness) caused at the rising edge and the falling edge of the signal pulse. Thus, the noise is reduced by the above-described method without increasing the manufacturing cost or using a special noise-reducing component or a noise-reducing design in the main body of the recording apparatus.

As described above, in the known structure, the noise can be reduced by an inexpensive method. However, according to this method, the heat enable signal is successively input to the delay circuits. Therefore, there is a possibility that the waveform of the heat enable signal will be changed in the delay circuits and the pulse width will also be changed as a result. The pulse width of the heat enable signal has an important role of defining the energy applied to the ink. Therefore, it is necessary that the heat enable signal input from the main body of the recording apparatus and the heat enable signal transmitted to the driver transistors from the circuits have the same pulse width.

In particular, in the circuit structure or the circuit layout used when the element substrate shown in FIGS. 7 and 8 has an ink supply port or when the element substrate has a long length, the electric wire for the heat enable signal has a large length. Therefore, there is a high risk that the pulse width will be changed because the signal shape is largely influenced by the parasitic load.

FIG. 10 illustrates the inner structure of the delay circuits to which the heat enable signal is input. FIGS. 11A and 11B are diagrams illustrating the manner in which the waveform of the heat enable signal is changed as the signal is transmitted through the delay circuits.

As described above, the delay circuits include CR integrating circuits for delaying the heat enable signal. The amount of delay generated by each delay circuit is determined by a capacitance C, a resistance R, and a threshold (Vth) of an inverter. The waveform of an output signal pulse output from each delay circuit is smoothed at the rising and falling edges in accordance with the capacitance and resistance, and the signal is transmitted to the next delay circuit when the smoothed pulse voltage reaches the threshold (Vth). In other words, the amount of delay is increased as the smoothness of the pulse is increased.

As shown in FIG. 10, each delay circuit includes two inverters connected in series.

More specifically, a first inverter 401 and a second inverter 402 are disposed next to each other and are connected to each other. The capacitance C for generating a delay is mainly determined by a gate of the second inverter 402, and the resistance R also for generating a delay is mainly determined by the driving performance of P-channel metal-oxide semiconductors (PMOSs) 403 or N-channel metal-oxide semiconductors (NMOSs) 404. A point at which the signal is input to the gate is shown as point B in FIG. 10. The signal waveform obtained at point B is indicated as point B in FIGS. 11A and 11B.

As is clear from the waveform at point B in FIGS. 11A and 11B, the waveform is not greatly smoothed by the capacitance and resistance because the delay circuit does not have other large loads. Therefore, the amount of delay is relatively small. Currents denoted by "a" and "b" in FIG. 10 correspond to portions denoted by "a" and "b" in the signal waveform indicated as point B in FIGS. 11A and 11B. In comparison, at the output point of the first delay circuit 111-1 that is shown as point C, the parasitic resistance and parasitic capacitance of the electric wire and a gate capacitance connected to AND circuits 405 are additionally applied. Although a plurality of AND circuits 405 are disposed between the delay circuits in each group, only one AND circuit 405 is shown for simplicity of the drawing.

Therefore, at point C, the signal waveform is further smoothed compared to that at point B, and the amount of delay is increased. This is clear from the signal waveform indicated by point C in FIGS. 11A and 11B. Currents denoted by "c" and "d" in FIG. 10 correspond to portions denoted by "c" and "d" in the signal waveform indicated as point C in FIGS. 11A and 11B.

Similarly, currents denoted by "e" and "f" in FIG. 10 correspond to portions denoted by "e" and "f" in the signal waveform indicated as point D in FIGS. 11A and 11B. In addition, currents denoted by "g" and "h" in FIG. 10 correspond to portions denoted by "g" and "h" in the signal waveform indicated as point E in FIGS. 11A and 11B.

Ideally, the threshold (Vth) of the inverters is equal to the center value of the power supply voltage (3.3 V), and the PMOSs 403 and the NMOSs 404 have exactly the same driving performance. In such a case, as shown in FIG. 11A, the amount of delay at the rising edge of the signal pulse is exactly the same as that at the falling edge. Therefore, the pulse width does not vary.

FIG. 11B shows the amount of delay of the heat enable signal obtained when the driving performance of the PMOSs 403 differs from that of the NMOSs 404. Here, the case is considered in which the PMOSs 403 have a higher driving performance than that of the NMOSs 404.

In this case, since the NMOSs 404 have a low driving performance, the falling edge of the pulse signal is smoothed, whereas the rising edge of the pulse signal is relatively sharp as compared to the falling edge because the PMOSs 403 have a high driving performance. As a result, the pulse width changes from that of the input signal. More specifically, as shown in FIG. 11B, the pulse width is successively reduced as the signal is transmitted to the downstream delay circuits. Conversely, if the NMOSs 404 have a higher driving performance than that of the PMOSs 403, the pulse width is successively increased.

To avoid such a situation, the width of each MOS (W) is designed such that the PMOSs 403 and the NMOSs 404 have the same driving performance. However, in the semiconductor substrate manufactured in practice, errors occur due to differences caused in semiconductor manufacturing processes. The errors cause deformation in the heat enable signal, which leads to variation in the pulse width. As a result, the energy applied to the heaters varies and recording defects occur.

SUMMARY OF THE INVENTION

The present invention is directed to an element substrate for a recording head capable of suppressing variation in a pulse width of a heat enable signal and supplying energy to recording elements with high accuracy. In addition, the present invention is also directed to a recording head, a head cartridge, and a recording apparatus including the element substrate.

An element substrate for a head according to an aspect of the present invention has the following structure.

The element substrate for a recording head includes groups of heating resistors configured to perform recording, the heating resistors being disposed next to one another in each group of heating resisters; logic circuits configured to divide the heating resistors into blocks and to time-divisionally drive the heating resistors in each group of heating resisters in units of one block; a heat enable signal line common to the groups of heating resisters, the heat enable signal line supplying a heat enable signal for defining a drive period of the heating elements to each group of heating resisters; and delay circuits disposed on the heat enable signal line at positions between the groups of heating resisters, the delay circuits delaying times at which the heating elements corresponding to each block are driven. A signal output from each delay circuit to the next group of heating resisters is inverted.

According to another aspect of the present invention, a recording head includes the element substrate having the above-described structure.

According to another aspect of the present invention, a recording head cartridge includes the above-described recording head and an ink tank containing ink to be supplied to the recording head. The ink tank is integrated with the recording head.

According to another aspect of the present invention, a recording apparatus includes the above-described recording head and a controller for supplying the heat enable signal to the recording head.

Further features of the present invention will become apparent from the following description of exemplary embodiments with reference to the attached drawings.

DESCRIPTION OF THE EMBODIMENTS

Figure 1:
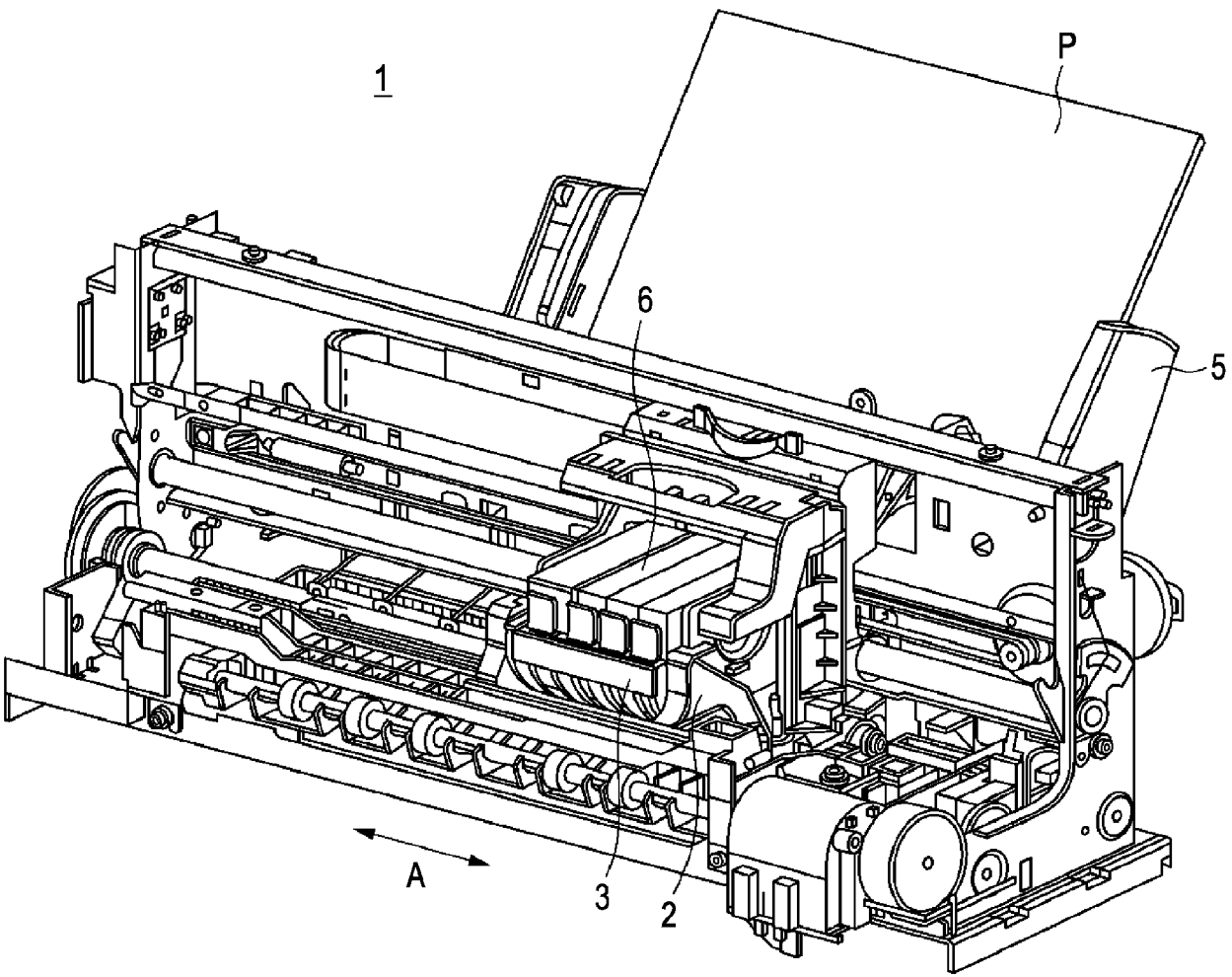
FIG. 1 is a perspective view of an inkjet recording apparatus according to an embodiment of the present invention.

Embodiments of the present invention will be described in detail below with reference to the accompanying drawings. Components similar to those described above are denoted by the same reference numerals and explanations thereof are thus omitted.

In the present specification, the term "record" refers not only to a process of forming significant information such as characters and figures but also to a process of forming images, designs, patterns, etc., on a recording medium or processing the medium irrespective of whether they are significant or visible to human eyes.

In addition, the term "recording medium" refers not only to paper which is commonly used in recording apparatuses but also to cloth, plastic films, metal plates, glass, ceramics, wood, leather, etc., which are capable of receiving ink.

In addition, the term "ink" (also called "liquid") is to be interpreted broadly similar to the term "record". Therefore, the term "ink" refers to any liquid that can be applied to the recording medium for forming images, designs, patterns, etc., on the recording medium, processing the recording medium, or processing ink (for example, for solidifying or insolubilizing coloring material in the ink applied to the recording medium).

In addition, the term "recording elements" refers broadly to discharge ports, liquid paths communicating with the discharge ports, and heating resistors which generate energy used for discharging ink unless specified otherwise.

An element substrate for a head (head substrate) described below does not refer to a simple substrate made of a silicon semiconductor, but refers to a structure including elements, electric wires, etc., provided thereon.

In addition, a region "on" the element substrate includes not only a region on top of the element substrate but also a region on a surface of the element substrate and an inner region of the element substrate near the surface thereof. In addition, according to the present invention, the term "integrally formed structure" does not refer to the structure in which an element formed separately from a substrate is simply placed on the substrate but to a structure in which each element is formed integrally with the element substrate in the process of manufacturing semiconductor circuits.

Ink-Jet Recording Apparatus (FIG. 1)

FIG. 1 is a perspective view of an ink-jet recording apparatus 1 according to an embodiment of the present invention.

Referring to FIG. 1, the ink-jet recording apparatus (hereinafter simply referred to as a "recording apparatus") 1 includes a carriage 2 and a recording head 3 mounted on the carriage 2. The recording head performs recording by discharging ink using an ink-jet method. The carriage 2 is reciprocally moved in the direction shown by arrow A. A recording medium P, such as recording paper, is supplied by a sheet-supply mechanism 5 and is conveyed to a recording position. Recording is performed by discharging ink from the recording head 3 onto the recording medium P at the recording position.

An ink cartridge 6 that stores ink to be supplied to the recording head 3 is mounted on the carriage 2 of the recording apparatus 1 together with the recording head 3. The ink cartridge 6 is detachable from the carriage 2.

The recording apparatus 1 shown in FIG. 1 is capable of color recording. Accordingly, four ink cartridges for storing magenta (M), cyan (C), yellow (Y), and black (K) inks are mounted on the carriage 2. The four ink cartridges are independently detachable.

The recording head 3 according to the present embodiment is an inkjet recording head that uses heat energy to discharge ink. Therefore, the element substrate of the recording head has heating resistors. The heating resistors are disposed at positions corresponding to the discharge ports. A pulse voltage is applied to the heating resistors in accordance with a recording signal, and ink droplets are discharged from the corresponding discharge ports.

Figure 2:
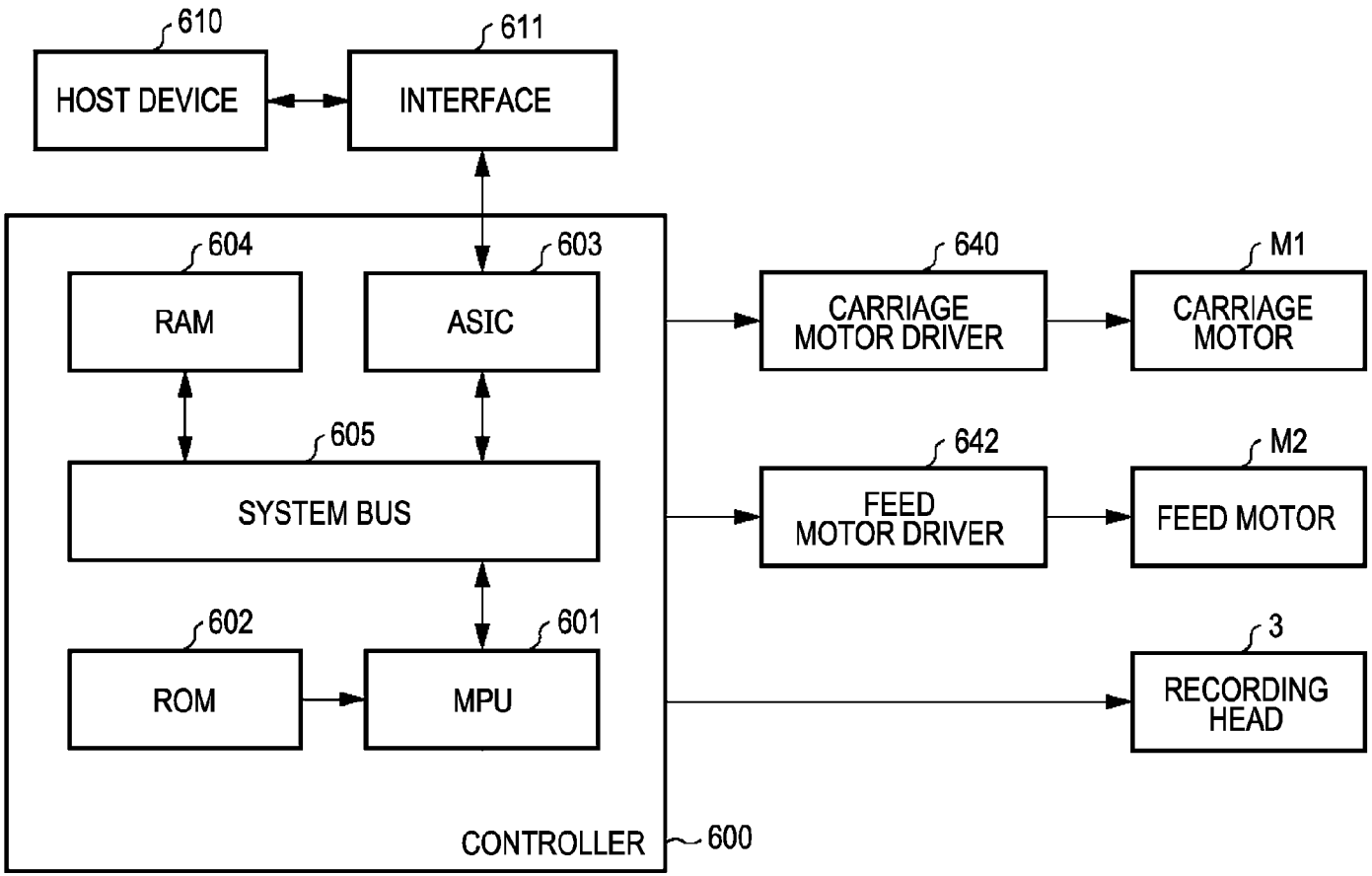
FIG. 2 is a block diagram of a control circuit of the recording apparatus shown in FIG. 1.

Control System of Ink-Jet Recording Apparatus (FIG. 2)

FIG. 2 is a block diagram showing a control system of the recording apparatus 1 shown in FIG. 1.

Referring to FIG. 2, a controller 600 includes a microprocessor unit (MPU) 601, a read-only memory (ROM) 602, an application specific integrated circuit (ASIC) 603, a random-access memory (RAM) 604, and a system bus 605. The ROM 602 stores programs corresponding to a control sequence, which will be described later, required tables, and other fixed data. The ASIC 603 functions as a controller and generates control signals for controlling a carriage motor M1, a feed motor M2, and the recording head 3. The control signals include a heat enable signal and a time-division drive signal, which will be described below, output to the element substrate of the recording head. The RAM 604 includes, for example, a recording-data expansion area and a work area for execution of programs. The system bus 605 connects the MPU 601, the ASIC 603, and the RAM 604 to each other to allow data exchange therebetween.

Referring to FIG. 2, a host device 610, which is a computer or the like, serves as a supply source for recording data. Image data, commands, status signals, or other signals are exchanged between the host device 610 and the recording apparatus 1 through an interface (I/F) 611. The recording data is input in the form of, for example, raster data.

A carriage motor driver 640 serves to drive the carriage motor M1 that reciprocally moves the carriage 2 in the direction shown by the arrow A. A feed motor driver 642 serves to drive the feed motor M2 that feeds the recording medium P.

The ASIC 603 transfers data (DATA) for driving heating resistors (heaters) to the recording head 3 while directly accessing a storage area of the RAM 602 during recording and scanning of the recording head 3.

In the structure shown in FIG. 1, the ink cartridge 6 and the recording head 3 can be separated from each other. However, the head cartridge may also be structured such that the ink cartridge 6 and the recording head 3 are formed integrally with each other.

Figure 3:
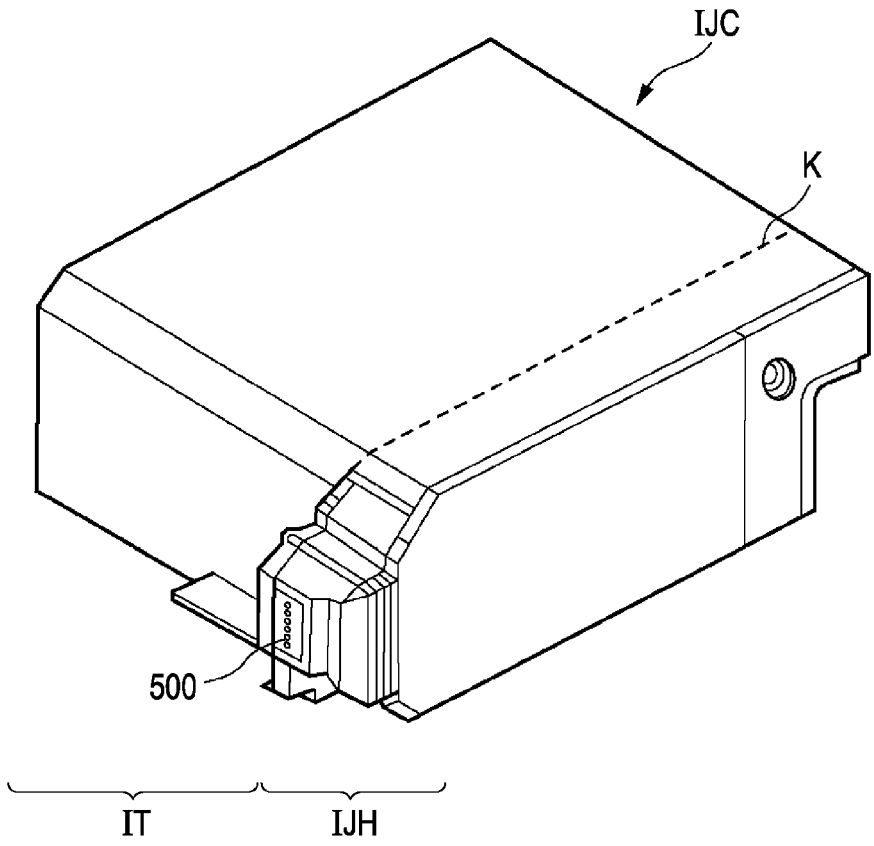
FIG. 3 is a perspective view of a head cartridge in which an ink tank and a recording head are formed integrally with each other.

FIG. 3 is a perspective view of a head cartridge IJC in which an ink tank IT and a recording head IJH are formed integrally with each other. In FIG. 3, the dotted line K shows the boundary between the ink tank IT and the recording head IJH. The head cartridge IJC has an electrode (not shown) that can receive an electric signal supplied from the carriage 2 when the head cartridge IJC is placed on the carriage 2. The recording head IJH is driven by the electric signal, and accordingly the ink is discharged. Referring to FIG. 3, the ink is discharged from a line of ink discharge ports 500.

An element substrate for a recording head according to the present embodiment includes at least a thin, long ink supply port extending in a predetermined direction. The element substrate including the ink supply port has an integrally formed structure in which heat-resistor arrays (heater arrays) are formed on the element substrate. Each heat-resistor array (heater array) has a plurality of heating resistors that are arranged along the longitudinal direction of the ink supply port and that serve to discharge ink supplied through the ink supply port to perform recording. The element substrate further includes a plurality of drivers (for example, driver transistors) arranged along the arrangement direction of the heating resistors and configured to drive the heating resistors and logic circuits arranged along the arrangement direction of the drivers. The logic circuits operate such that the drivers are divided into a plurality of drive blocks and are time-divisionally driven in each drive block. Metal-oxide-semiconductor field effect transistors (MOSFETs), for example, are used as the drive transistors.

Figure 8:
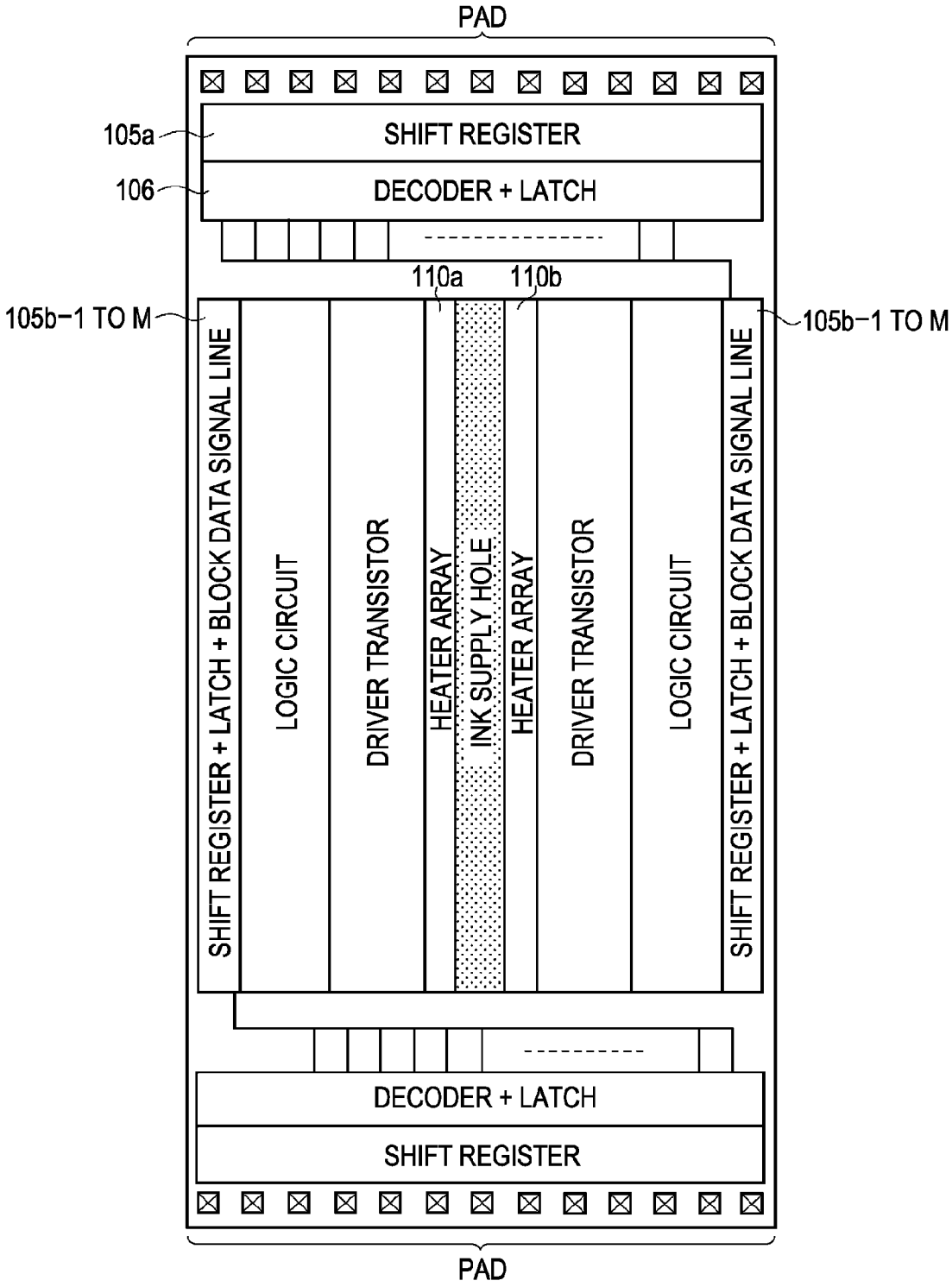
FIG. 8 is a schematic diagram illustrating the circuit layout of the recording head shown in FIG. 7.
Figure 9:
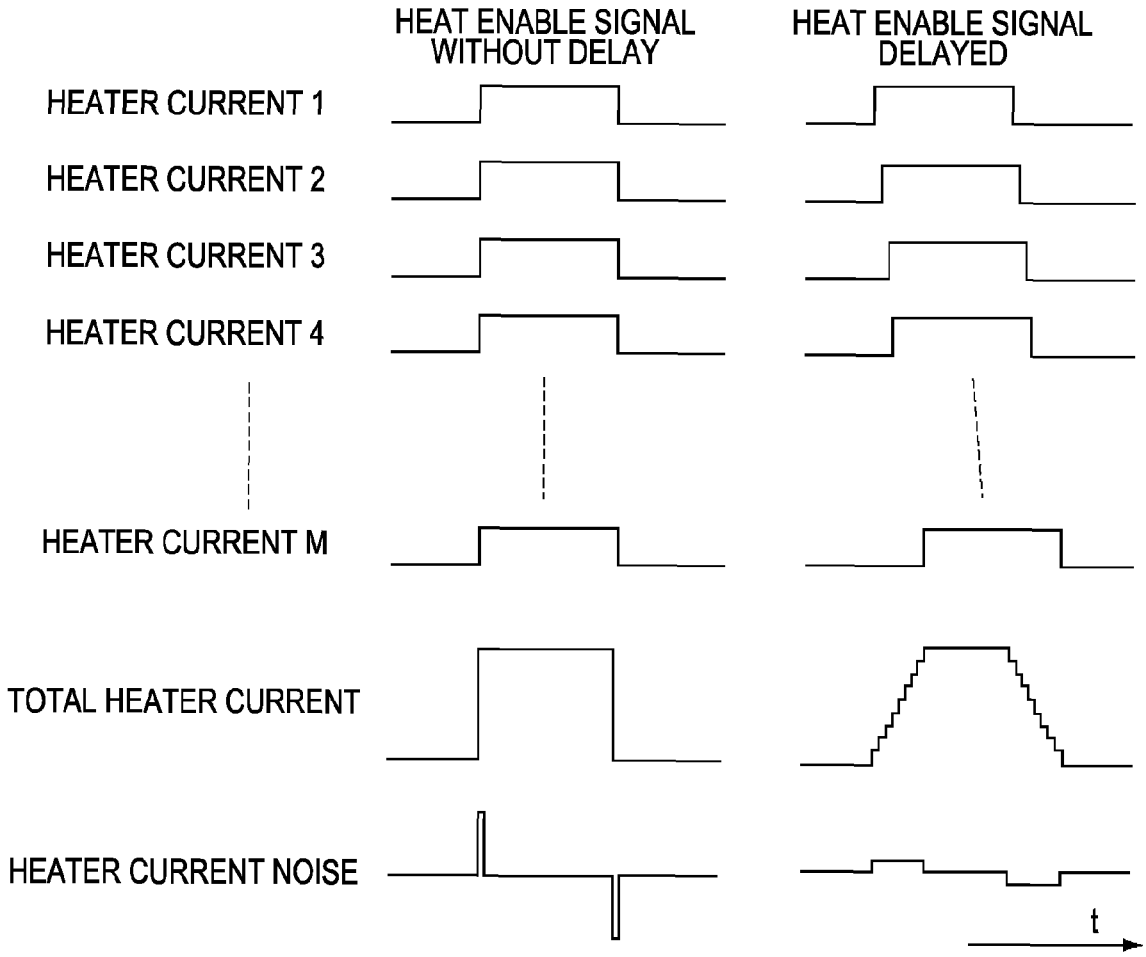
FIG. 9 PRIOR ART
FIG. 9 a signal time chart illustrating delay control of the heat enable signal.

Accordingly, similar to the structure shown in FIG. 8, the head substrate according to the present embodiment also has a layout in which an ink supply port, heater arrays, driver transistors, and logic circuits are provided.

Figure 7:
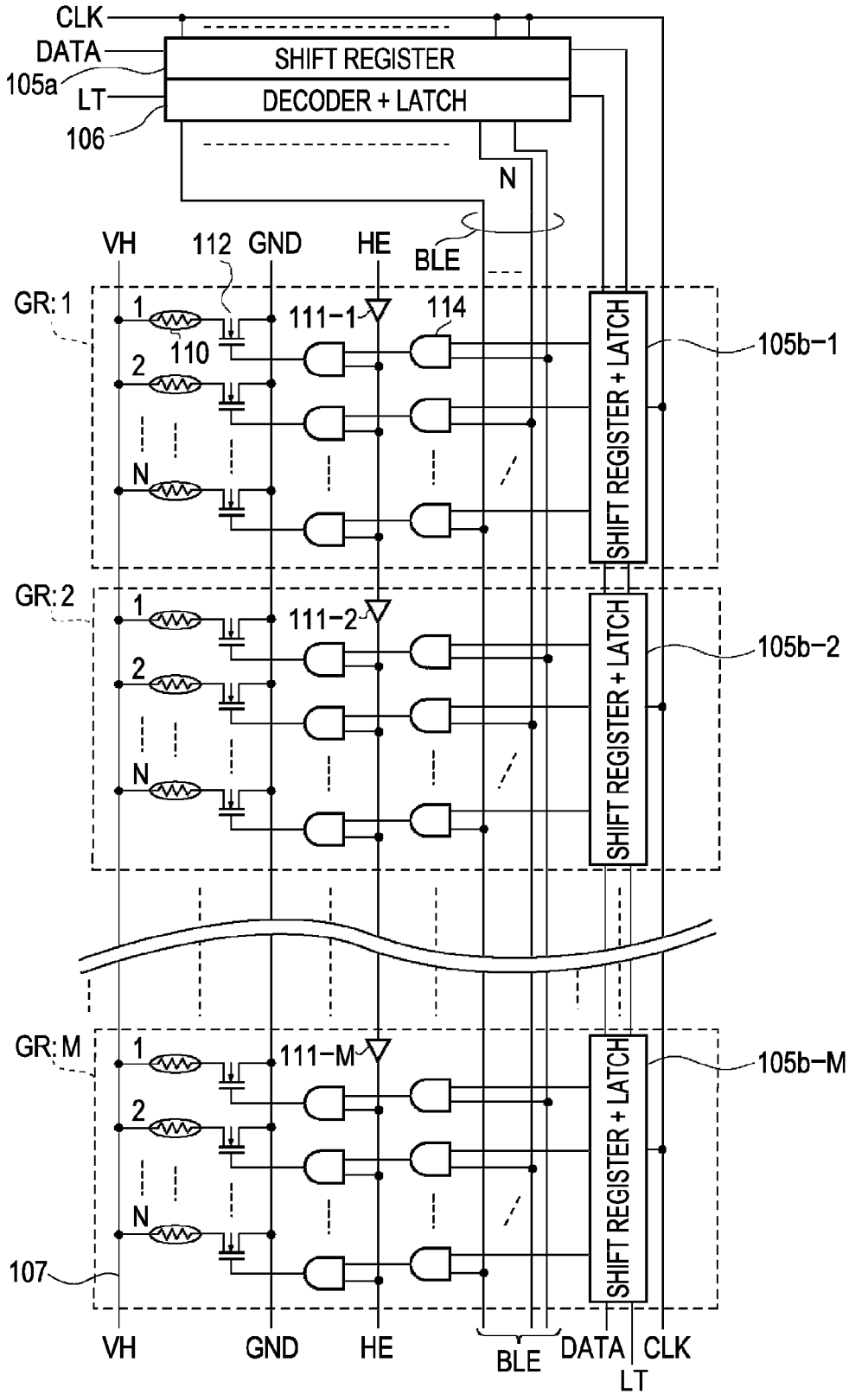
FIG. 7 is a block diagram illustrating the circuit structure of a recording head.

In addition, similar to the structure shown in FIG. 7, also in the element substrate according to the present embodiment, a heat enable signal that defines the drive period of each heating resistor is input to delay circuits for delaying the time at which the heat enable signal is applied. A heat enable signal line for the heat enable signal is provided as a serial signal line common to the groups of heating resistors. Although not shown in FIG. 7, according to the present embodiment, an inverting circuit, which will be described below with reference to FIG. 4, is provided at an input position of each AND circuit for obtaining the logical product of the heat enable signal and an output signal from the corresponding AND circuit 114.

Figure 4:
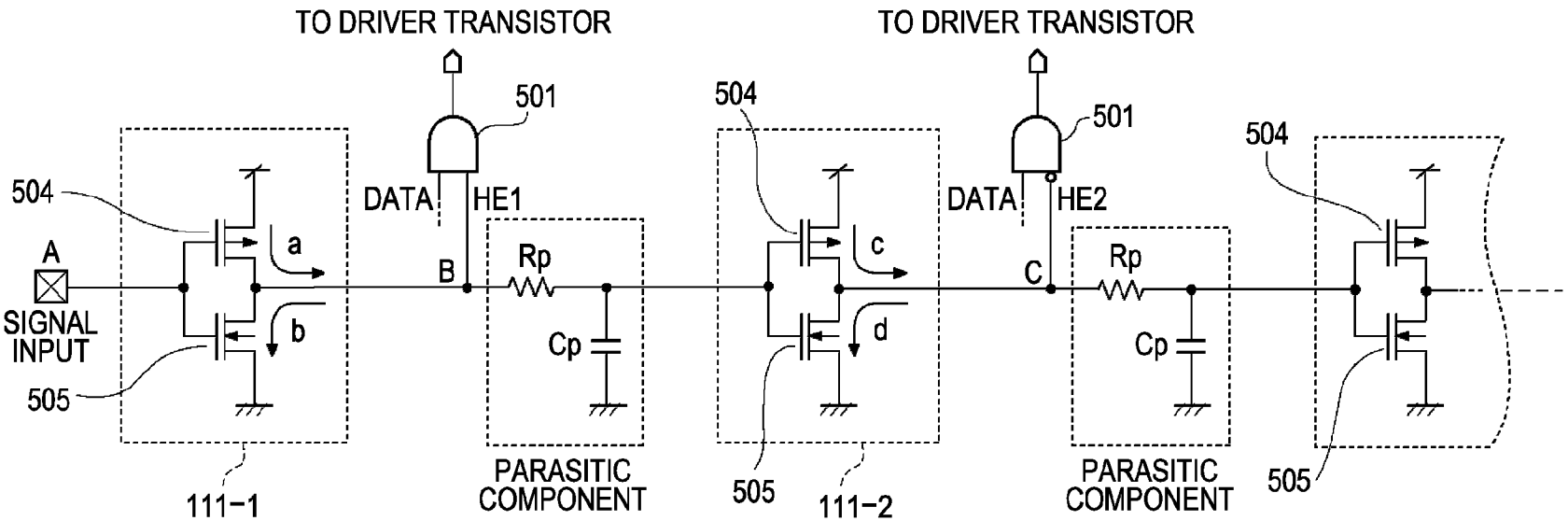
FIG. 4 illustrates the structure of delay circuits according to the embodiment and parasitic components of an electric wire for a heat enable signal.

FIG. 4 illustrates the structure of the delay circuits according to the present embodiment and parasitic components of the electric wire for the heat enable signal.

The delay circuits having the structure shown in FIG. 4 are used as the delay circuits in the head substrate circuit structure shown in FIG. 7.

Figure 10:
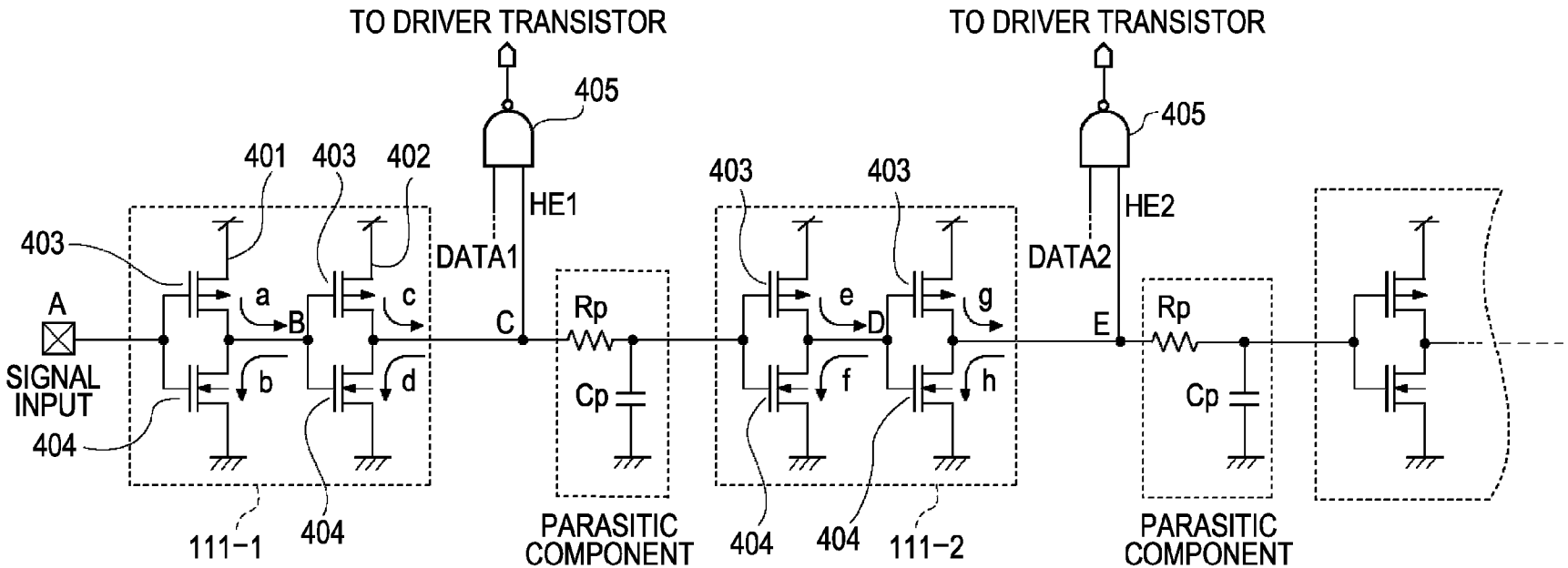
FIG. 10 a diagram illustrating the inner structure of delay circuits to which the heat enable signal is input.
Figure 11A:
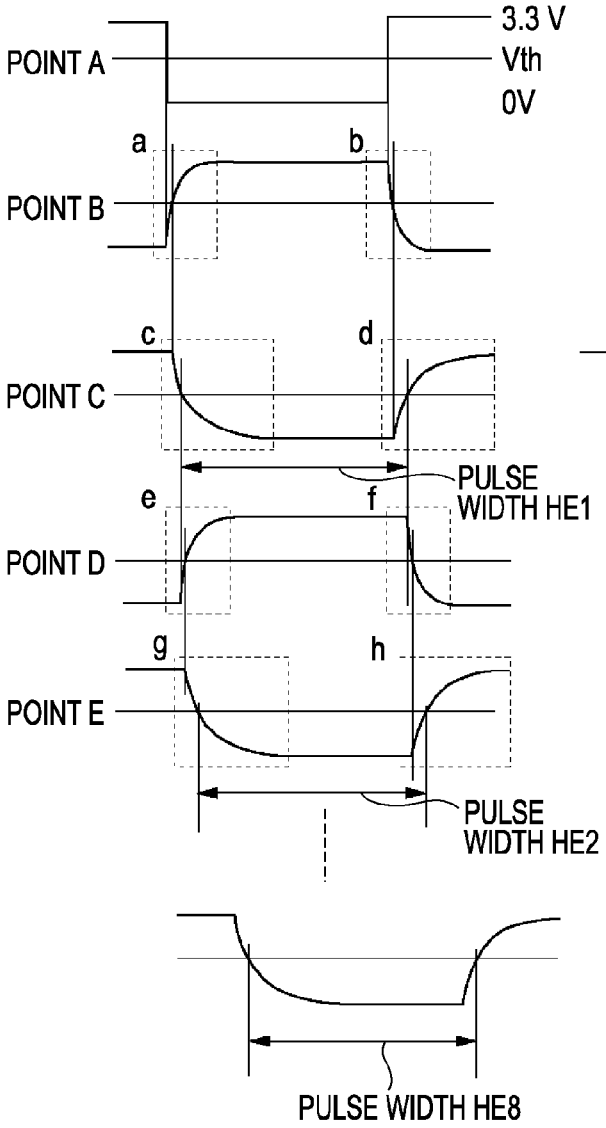
FIGS. 11A and 11B are diagrams illustrating the manner in which the waveform of the heat enable signal is changed as the signal is transmitted through the delay circuits.
Figure 11B:
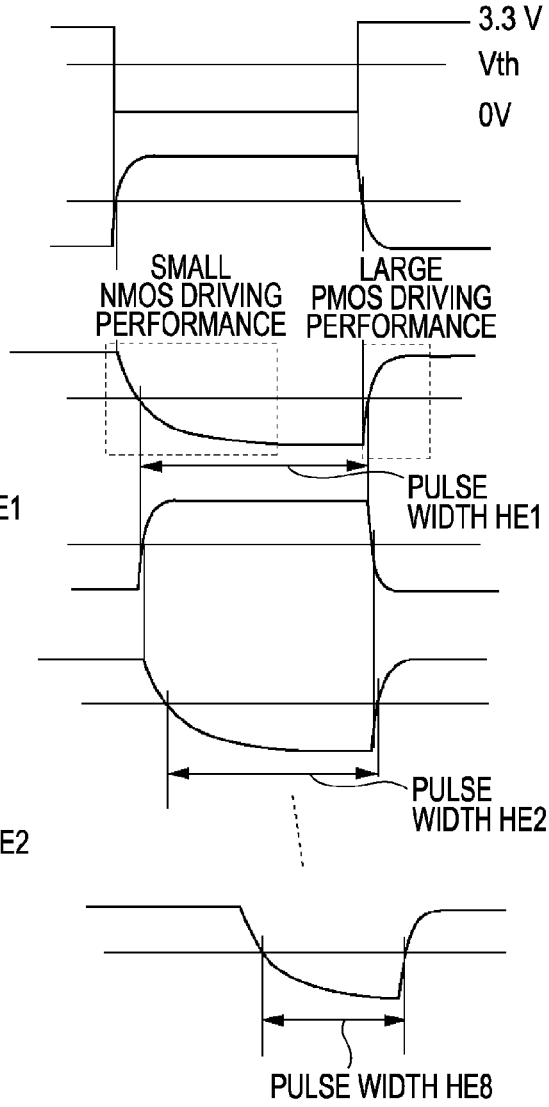

In the known structure, each of the delay circuits includes two inverters, as shown in FIG. 10. In comparison, according to the present embodiment, each of the delay circuits includes one inverter. The delay circuits are connected in series by the heat enable signal line. Each of the inverters includes a PMOS 504 and an NMOS 505.

Due to the above-described structure, in each of the inverters included in the delay circuits, the downstream inverters, the heat enable signal line, the AND circuits 501 in each group, etc., are equivalently connected. Therefore, all of the inverters receive the same output load (capacitance C and resistance R). Although a plurality of AND circuits 501 are disposed between the delay circuits in each group, only one AND circuit 501 is shown in FIG. 4 for simplicity of the drawing.

Figure 5:
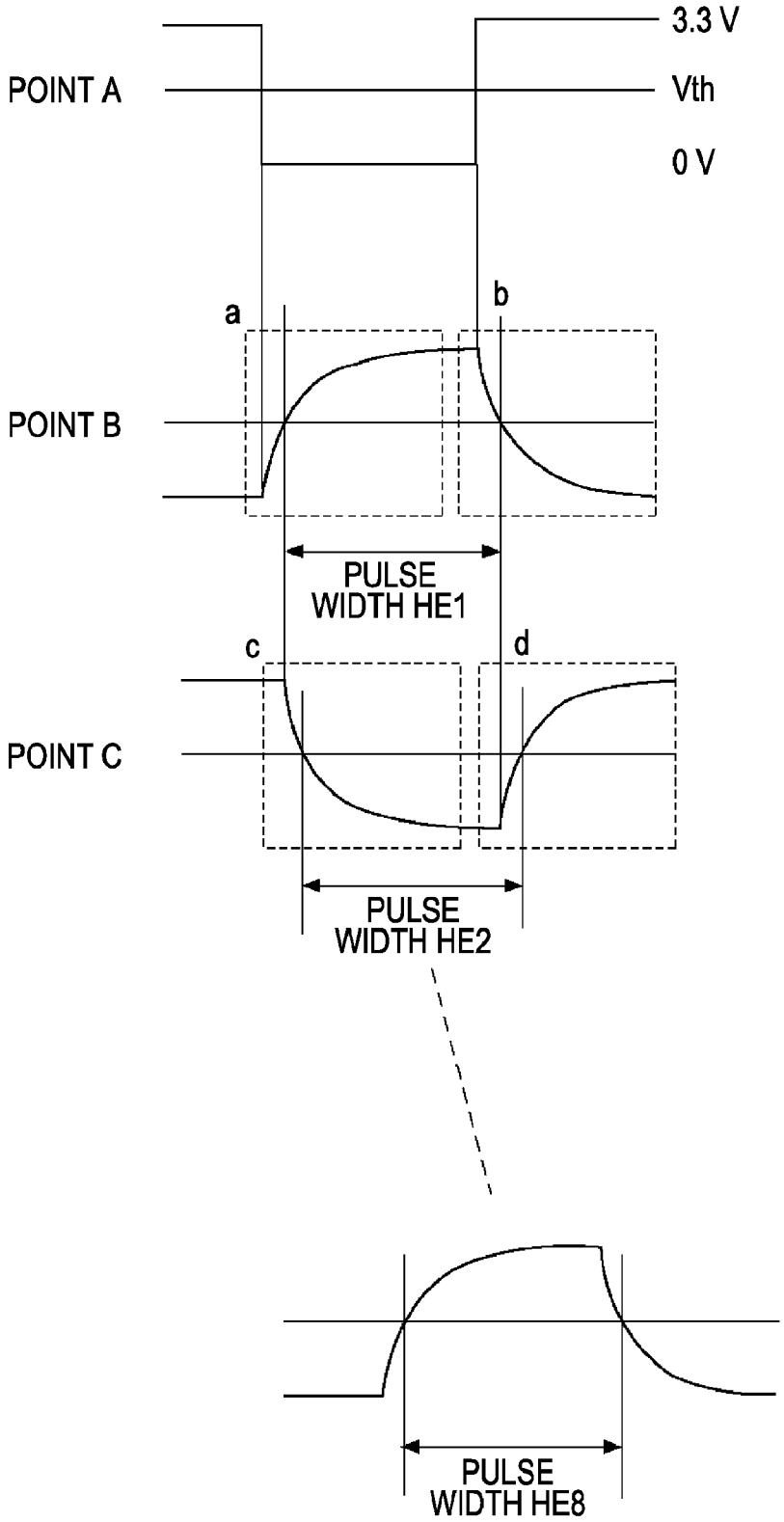
FIG. 5 illustrates the manner in which the waveform of the heat enable signal is changed as the signal is transmitted through the delay circuits.

FIG. 5 illustrates the manner in which the waveform of the heat enable signal is changed as the signal is transmitted through the delay circuits. Currents denoted by "a" and "b" in FIG. 4 correspond to portions denoted by "a" and "b" in the signal waveform indicated as point B in FIG. 5. Currents denoted by "c" and "d" in FIG. 4 correspond to portions denoted by "c" and "d" in the signal waveform indicated as point C in FIG. 5.

As shown in FIG. 5, the heat enable signal pulse is output as a logic signal inverted at each of the delay circuits, and is successively transmitted to the next block. The inverted heat enable signal can be changed to a logic signal similar that in the known structure by placing an inverter on each of the signal lines separated from the heat enable signal line toward each group or at the input of each AND circuit 501.

In the known circuit structure, if the driving performance of the PMOSs differs from that of the NMOSs, the signal pulse width is changed as the heat enable signal is transmitted to the downstream delay circuits.

In comparison, according to the structure of the present embodiment, the inverters of the delay circuits have substantially the same output load, and the heat enable signal is transmitted as a logic signal inverted at each of the delay circuits. Therefore, even if the pulse width is slightly changed in the first delay circuit 111-1, the pulse width is changed in the opposite direction in the second delay circuit 111-2. Therefore, the change in the pulse width is prevented from being increased as the signal is transmitted to the downstream delay circuits.

In the known structure, as the number of heaters that are simultaneously driven is increased, the number of delay circuits is also increased. Therefore, the change in the pulse width is also increased. In addition, in the layout structure and the circuit structure shown in FIGS. 7 and 8, the electric wire between the delay circuits is long. Accordingly, the electric wire has a large parasitic load, which causes the change in the pulse width.

In comparison, according to the present embodiment, the change in the pulse width can be suppressed even if the number of heaters that are simultaneously driven is increased and the load of the electric wire is increased due to the increase in the number of delay circuits in the structure shown in FIGS. 7 and 8. The effect of the preset embodiment becomes more significant when the number of recording elements in the substrate is increased or when the length of the substrate is increased.

The number of inverters included in each delay circuit according to the present embodiment is smaller than that in the known structure by one. Therefore, if the characteristics of the inverters used in the present embodiment are the same as those of the inverters used in the known structure, the amount of delay is reduced. Accordingly, the amount of delay can be increased by adding a dummy capacitance, an additional electric wire resistance, etc. Alternatively, the amount of delay can also be increased by increasing the gate length (L) of the NMOS 505 and the PMOS 504 so as to reduce the driving performance of each MOS transistor.

However, if the driving performance of the PMOS and that of the NMOS are slightly different from each other, the pulse width of the heat enable signal will be changed in the next delay circuit.

Therefore, to prevent the pulse width of the heat enable signal from being changed in the next delay circuit, the driving performance of the MOS transistors, the parasitic capacitance C, and the parasitic resistance R can be maintained. To increase the amount of delay without reducing the driving performance, the number of inverters included in each delay circuit can be increased. In addition, as is clear from the structure and effect of the above-described embodiment, the pulse width of the heat enable signal can be prevented from being changed by outputting the signal as a logic signal inverted at each of the delay circuits. Therefore, the number of inverters connected in series in each delay circuit can be set to three or more odd numbers. According to this structure, the heat enable signal can be transmitted to the next delay circuit without changing the pulse width thereof.

In such a structure, the change in the pulse width caused between the adjacent delay circuits can be reduced as compared to that in the above-described embodiment. As a result, the energy can be applied to the heaters with a higher accuracy.

Figure 6:
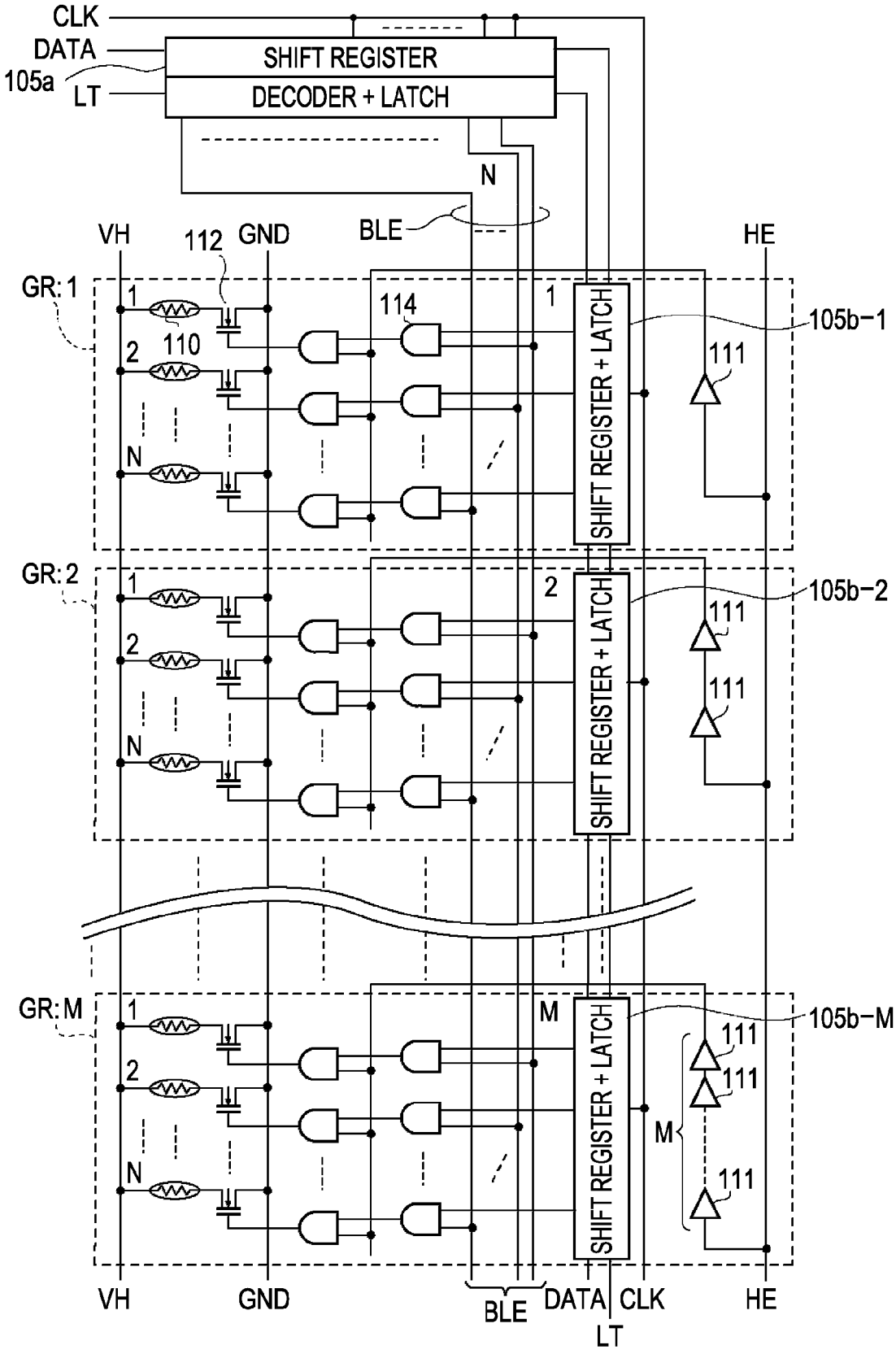
FIG. 6 is a block diagram illustrating the circuit structure of a recording head according to a modification of the embodiment.

FIG. 6 is a block diagram illustrating the circuit structure of a recording head according to a modification of the above-described embodiment.

Referring to FIG. 6, group M (GR:M) has a delay-circuit unit including M delay circuits 111 connected in series, group 2 (GR:2) has a delay-circuit unit including two delay circuits 111 connected in series, and group 1 (GR:1) has a delay-circuit unit including a single delay circuit 111. The heat enable signal (HE) is input to the delay-circuit units in parallel.

In this case, it is difficult to make the circuit structure simple because heat enable signal lines are provided in parallel. However, all of the groups can receive heat enable signal pulses having the same width.

In the above-described circuit structure, the recording data signals are output from the combinations of the shift registers and the corresponding latches, and the block selection signal is output from the combination of the decoder and the corresponding latch. The logic products of the recording data signals and the block selection signal are obtained by the AND circuits, and then the logic products of the outputs from the AND circuits and the heat enable signal are obtained by other AND circuits. However, the present invention is not limited to this. For example, first, the heat enable signal and one of the block selection signal and the recording data signals can be fed to AND circuits, and then outputs from the AND circuits and the other one of the block selection signal and the recording data signals can be fed to other AND circuits.

According to the above-described embodiments, the pulse width of the heat enable signal can be prevented from being changed. Accordingly, the heating resistors can be driven with high accuracy and high-quality recording can be performed.

Since energy can be applied to the heaters with high accuracy, errors between the design values of the head and the actual values can be reduced. Accordingly, the design margin for the energy applied to the heaters can be reduced. This means that the recording head can be prevented from receiving excessive energy for a large margin. Accordingly, power consumption can be reduced and the lift of the recording head can be increased.

In the above embodiment, ink droplets are discharged from the recording head, and ink is stored in the ink tank. However, liquid stored in the ink tank is not limited to ink, and may also be processing liquid to be discharged onto a recording medium in order to enhance fixability and water resistance of a recorded image or to improve image quality.

In addition, the inkjet recording apparatus according to the embodiment of the present invention is not limited to an image output apparatus of an information processing apparatus, such as a computer. The inkjet recording apparatus can also be, for example, a copying machine having a reader installed therein, a facsimile machine having transmitting and receiving functions, etc.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Application No. 2007-096594 filed Apr. 2, 2007, which is hereby incorporated by reference herein in its entirety.

What is claimed is:

1. An element substrate for a recording head, comprising:

groups of heating resistors configured to perform recording, the heating resistors being disposed next to one another in each group;

logic circuits configured to divide the heating resistors into blocks and to time-divisionally drive the heating resistors in each group in units of one block;

a heat enable signal line common to the groups of heating resistors, the heat enable signal line supplying a heat enable signal for defining a drive period of the heating resistors to each group of heating resistors; and delay circuits connected to the heat enable signal line at positions between the groups of heating resistors, the delay circuits delaying timing at which the heating resistors corresponding to each block are driven, wherein a signal output from each of the delay circuits to the next group is inverted.

2. The element substrate according to claim 1, wherein each delay circuit includes an odd number of inverters.

3. The element substrate according to claim 2, wherein the number of inverters is one.

4. The element substrate according to claim 2, wherein the number of inverters is three or more.

5. The element substrate according to claim 1, wherein each heating resistor generates heat energy for discharging ink.

6. The element substrate according to claim 1, further comprising:

an ink supply port, wherein the heating resistors are arranged along a longitudinal direction of the ink supply port.

7. A recording head that performs recording by discharging ink, the recording head comprising:

the element substrate according to claim 1; and discharge ports.

8. A recording head cartridge, comprising:

the recording head according to claim 7; and an ink tank containing ink to be supplied to the recording head, the ink tank being integrated with the recording head.

9. A recording apparatus, comprising:

the recording head according to claim 7; and a controller configured to supply the heat enable signal to the recording head.

* * * * *